US005271641A

United States Patent [19]

Whited

[11] Patent Number: 5,271,641

[45] Date of Patent: Dec. 21, 1993

[54] AIR BAGGAGE TAG

[75] Inventor: Freddie L. Whited, Buckhannon, W. Va.

[73] Assignee: Moore Business Forms, Inc., Grand Island, N.Y.

[21] Appl. No.: 825,766

[22] Filed: Jan. 21, 1992

Related U.S. Application Data

[60] Continuation of Ser. No. 539,155, Jun. 18, 1990, abandoned, which is a division of Ser. No. 462,037, Jan. 8, 1990, Pat. No. 4,951,971.

[51] Int. Cl.[5] ..... G09F 3/20

[52] U.S. Cl. ..... 283/80; 283/105

[58] Field of Search ..... 283/80, 105; 40/6, 638

[56] References Cited

U.S. PATENT DOCUMENTS

| | | | |
|---|---|---|---|
| 2,274,488 | 2/1942 | Kutscher | 283/105 |
| 4,318,235 | 3/1982 | Augeri | 283/105 |
| 4,631,845 | 12/1986 | Samuel et al. | 40/638 |
| 4,637,635 | 1/1987 | Levine | 283/105 |
| 4,880,964 | 11/1989 | Donahue | 283/105 |
| 4,951,971 | 8/1990 | Whited | 283/80 |

OTHER PUBLICATIONS

Farecard "America's #1 Transit System", Washington, D.C. metro subway.

*Primary Examiner*—Douglas D. Watts

*Assistant Examiner*—Hwei-Siu Payer

*Attorney, Agent, or Firm*—Nixon & Vanderhye

[57] ABSTRACT

A luggage tag attachable to the handle of a piece is of the type comprising a face stock and a release liner with a longitudinal fold line scored into the tag and extending from one end of the tag to terminate at a point between the first and second ends of the tag, the tag being foldable about the fold line. A detachable ticket or receipt is integrally formed in the center of the tag extending from the root of the fold line to the second end of the tag, and tongues are formed in the tag on each side of the detachable ticket. Reinforcing tear-resistant strips, such as Mylar ® tape strips, are provided on the back of the face stock extending at least the lengths of the tongues, and preferably the entire length of the face stock. The back of the face stock has adhesive over the entire area thereof, but a pattern of varnish desensitizer is provided along a portion of each of the tongues, so that adhesive is not transferred to a luggage handle when it is disposed between the tongues. The face stock and release liner both have curved edges, with the radius of curvature of the release liner edges being greater than that of the face stock edges. Paper ties are provided between the tongue and the ticket so as to prevent premature, undesired detachment of the ticket from the tongues and root, each paper tie having a length of about 0.025 inches.

2 Claims, 2 Drawing Sheets

FIG. 2
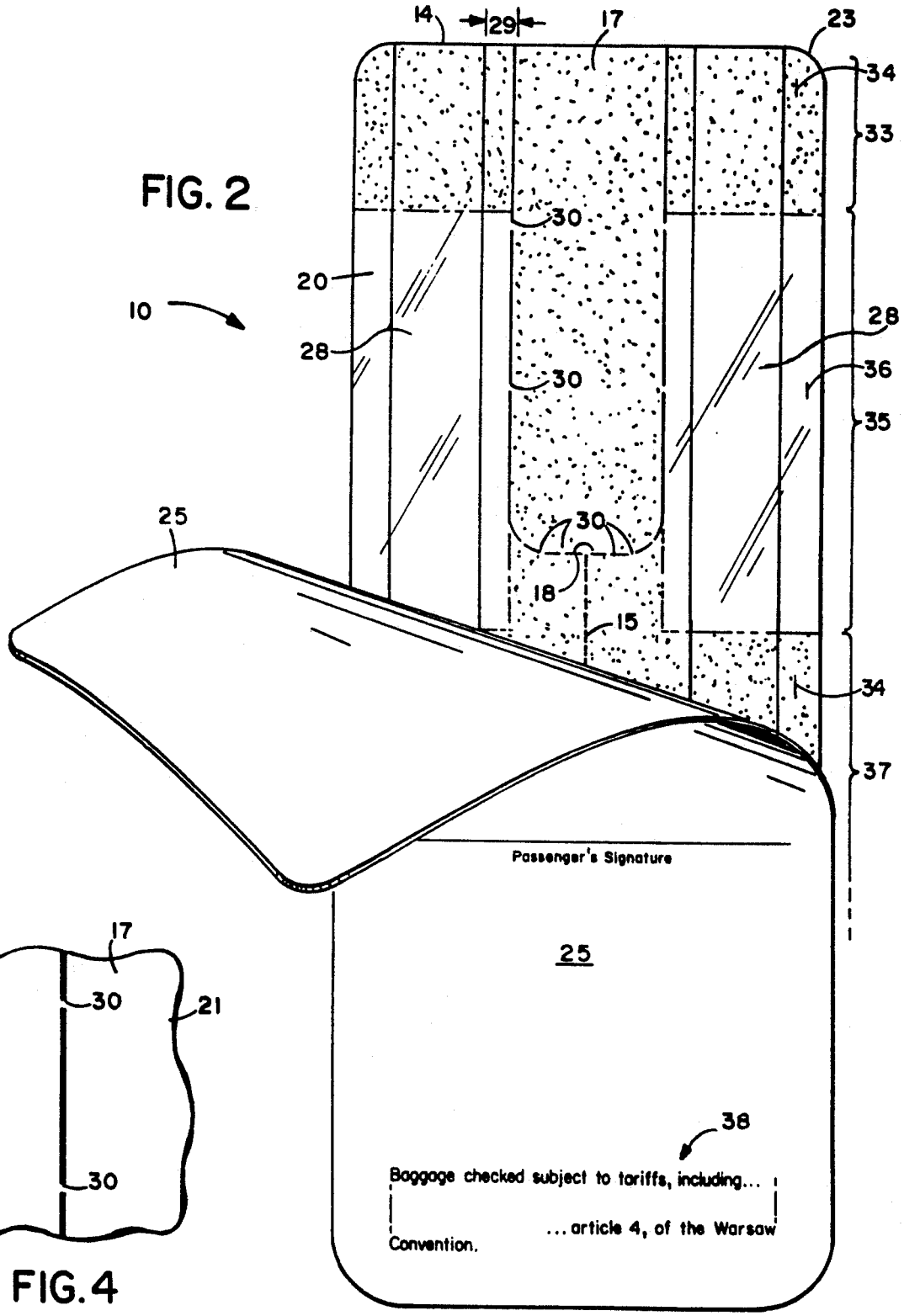
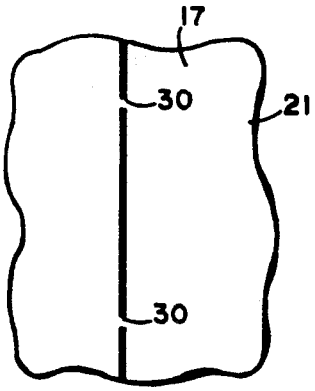
FIG. 4

AIR BAGGAGE TAG

This is a continuation of application Ser. No. 07/539,155, filed Jun. 18, 1990, now abandoned which is a division of application Ser. No. 07,462,037, filed Jan. 8, 1990, now U.S. Pat. No. 4,951,971.

BACKGROUND AND SUMMARY OF THE INVENTION

The invention relates to a particular type of air baggage tag which is readily attachable to the handle of an individual piece of luggage, can be run through printing equipment easily, and provide a ticket (receipt) that is readily detachable from the rest of the tag when desired. The invention relates to an improvement over the type of luggage tag illustrated and described in U.S. Pat. No. 4,631,845, the disclosure of which is hereby incorporated by reference herein.

While the luggage tag illustrated in the U.S. Pat. No. 4,631,845 has had the potential to be an excellent tag—that is, versatile and easy to use—it has never realized its potential because of a wide variety of practical difficulties. Despite extensive efforts to make the luggage tag of the U.S. Pat. No. 4,631,845 into a commercially successful product, it has not had the necessary properties desired to be successful commercially until the improvements of the present invention.

There have been a number of practical problems associated with the luggage tag of the U.S. Pat. No. 4,631,845 that has hampered its success, including problems with feeding through a printer. The tag as illustrated in the U.S. Pat. No. 4,631,845 has had a tendency to jam in the conventional printer with which it has been utilized (e.g., a Datamax 5000 Printer), not feeding properly through the printer, or becoming easily torn. There have been also a wide variety of practical problems including ease of attachment of tongues of the luggage tag to the luggage handle, undesired detachment of the receipt portion from the tongues, and tearing of the tag, particularly the tongue portions.

There are a number of minor improvements that are provided according to the invention, such as the particular paper that is utilized, the provision of the release liner so that it is larger than the face stock and the like. In addition, there are a number of significant revisions that make the difference between a product that is commercially worthwhile and one that is not. The major improvements include the following:

In order to significantly improve the tear resistance, strips of tape of a non-tearing material (e.g., Mylar®) are applied the full length of the back of the face stock, parallel to the receipt portion edge and spaced only a small portion therefrom. The tape must extend at least the length of the tongue portions, but preferably extends the entire length of the face stock.

The corners of the tag, instead of being square, are rounded so as to allow them to feed through the printer more easily and prevent jams. It is desirable that the radius of the corners in the face stock be less than the radius of the liners, which is possible if the liner is slightly greater in dimension than the face stock.

To prevent separation of the receipt from the tongues during feeding through equipment, or, when not desired, paper ties are provided between the tongues and the receipt. Preferably, at least two ties are provided along each edge of the receipt and the tongues, and a plurality of ties are provided between the bottom of the receipt and the main body of the face stock. The ties preferably have an effective length of about 0.025 inches.

In order to provide proper attachment of the tongues to each other when placed around the luggage handle, yet not to cause adhesive to be scraped onto the luggage handle, a patterned varnish desensitizer is applied over the adhesive along the main body of each the tongue. The adhesive desensitizer is applied from a position about one inch from the end of the tongues to a position past the root of the tongues, while adhesive remains on the receipt portion and the first edge of each of the tongues.

It is a primary object of the present invention to provide an effective luggage tag of the type having a pair of tongues for the receipt between the tongues. This and other objects of the invention will become clear from an inspection of the detailed description of the invention and from the appended claims.

BRIEF DESCRIPTION OF THE DRAWINGS

FIG. 2 is a bottom plan view of a portion of the tag of FIG. 1, with the release liner illustrated peeled back for clarity of illustration;

FIG. 4 is a detailed plan view showing the paper ties for attaching the receipt to the tongue of the tag of FIGS. 1 and 2.

DETAILED DESCRIPTION OF THE DRAWINGS

Figure 1:
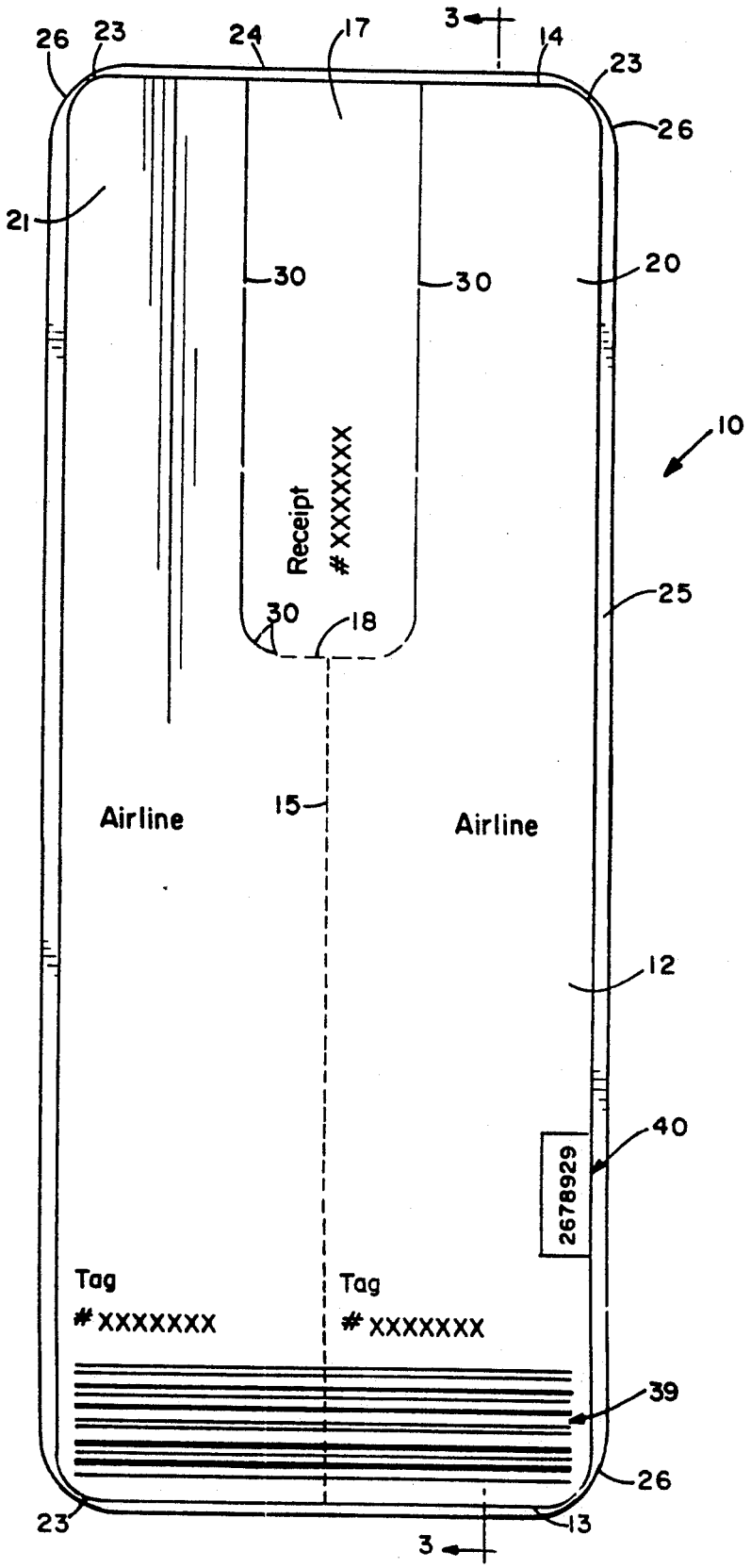
FIG. 1 is a top plan view of an exemplary air baggage tag according to the invention.
Figure 3:
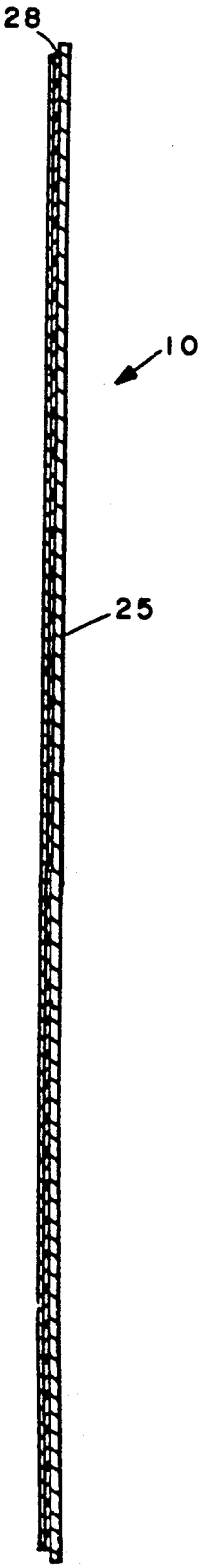
FIG. 3 is a detailed side view of the tag of FIG. 1.

A luggage tag according to the present invention is shown generally by reference numeral 10 in FIGS. 1 through 3. The tag 10 includes a face stock 12 which is comprised of an elongate strip of flexible material having a first end 13 and a second end 14. The face stock 12 preferably is paper such as a sixty pound wet strength paper with a smudge proof coating. A fold line 15 is scored along the longitudinal center line of the tag 10 and extends from the first end 13 to a point 18 that is located away from the second end 14 by a significant distance, e.g., about 30–40% of the length of the tag.

Part of the face stock 12 comprises a detachable "ticket" or "receipt" portion 17. The receipt portion 17 typically is printed with indicia which corresponds to indicia on the body of the face stock 12 (e.g., the tag number), and one or both may have bar coding, such as shown in U.S. Pat. No. 4,631,845. An OCR readable type 40 corresponding to the bar coding 39 may be provided.

The face stock 12 also comprises tongue portions 20, 21 on opposite sides of the receipt 17. It is highly desirable that instead of the luggage tag being completely rectangular, with squared edges, as illustrated in the U.S. Pat. No. 4,631,845, that it have rounded edges. Such rounded edges are illustrated by reference numeral 23 in FIGS. 1 and 2, the radius of the edges 23 of the face stock 12 preferably being about one-quarter inch. This rounded edge minimizes machine jamming.

It is highly desirable that the luggage tag 10 include a release liner 25 to which the face stock 12 is adhesively attached. The release liner 25 may be of a conventional fifty pound release paper construction, such as that available from Atlas. The release stock 25 has a leading edge 24 which is attached, by perforations or the like, to like luggage tags 10 in a continuous strip of business forms, for ease of feeding through a printer. The edges 26 of the release liner 25 are also rounded, although the radius or curvature is preferably different than that of the face stock edges 23. The corner radius of the corners 26 is preferably about seven-sixteenth inch, i.e., slightly greater than that of the face stock corners 23.

In order to provide tear resistance for the tag, both to ensure jam free handling through mechanical equipment, and also when used on luggage, reinforcing material is provided on the face stock 12, at least over the length of the tongue portions 20, 21 thereof, and preferably along the length of the entire face stock 12. Such tear resistant strips are illustrated in FIGS. 2 and 3 generally by reference numeral 28. They preferably comprise strips of Mylar® tape, or like tape having tear resistance properties similar to that of Mylar®, that is adhesively secured to the back of the face stock 12. The adhesive coated Mylar® tape preferably has a width of about one-half inch, and is spaced only a very small distance 29 (see FIG. 2) from the side edges of the receipt portion 17, e.g., the distance 29 being about one-eighth of an inch.

In order to prevent premature or undesirable separation between the receipt 17 and the rest of the face stock 12, it is preferable to use paper ties. Paper ties 30 are inherently formed if the tongue portion 17 is die cut, with particularly constructed dies, from the rest of the face stock 12. Preferably, two paper ties 30 are provided on each edge of the receipt 17 between the edge and the corresponding tongue 20, 21, and a plurality (e.g., seven) of paper ties 30 are provided at the edge 18 between the receipt 17 and the main body of the face stock 12. The paper ties 30 are illustrated most clearly in FIG. 4, and preferably have a length of at least 0.020 inches, more preferably about 0.025 inches. With a length of about 0.025 inches, the ties 30 have a sufficient strength to ensure no premature detachment, but are not so sturdy as to prevent clean and easy separation between the receipt 17 and the rest of the face stock 12.

In order to provide the most secure attachment of the face stock 12 to the luggage, while not transferring adhesive from the tag 10 to the luggage handle, it is preferred that there be three different zones on the back of the face stock 12 (except for the receipt 17). As illustrated in FIG. 2, there is a first zone 33 of the backs of the tongue portion 20, 21 that extends from the edge 14 down toward the end 13, that is about one inch in length. Adhesive 34 is applied to the entire back of the face stock 12; and, except for areas where it is desensitized, the face stock 12 backs will stick to each other when the adhesive portions thereof are pressed against each other. However, there is a second zone 35, starting at about the area of the first paper tie 30, one inch from the edge 14, which extends approximately three inches in length down past the root 18 of the receipt 17, upon which a desensitizing material 36 is applied. Preferably, a patterned varnish desensetizer, such as Translite Varnish—G.P.I. #CL-77-1295, is printed over the adhesive and the tape 28. Thus, the zone 35 portion of the tongues of the back of the face stock will not be adhesively secured to each other during use. The desensitizing varnish is not applied to the back of the receipt portion 17, so that it remains adhesive.

Below the zone 35 is a zone 37 which extends from about an inch below the root 18 to the first end 13 of the face stock 12. There is no desensitizer applied in that area, therefore, the entire zone 37 is adhesive.

Note that it is desirable to also print the back of the liner 25—as indicated by reference numeral 38 in FIG. 2.

The utilization of the tag 10 according to the invention is basically the same as that of the tag of U.S. Pat. No. 4,631,845. One of the corners 23 is grasped, and the face stock 12, except for the receipt portion 17 thereof, is detached from the release liner 25. Alternatively, just the ticket 17 is grasped and detached from the rest of face stock 12, and then the rest of the face stock. In either case, the paper ties 30 are severed. The receipt portion 17 is given to the customer, while the rest of the face stock 12 is placed so that the tongues 20, 21 are on either side of the handle of a piece of luggage. Then, the face stock 12 is folded along the fold line 15, and the zone portions 33 are brought into face-to-face contact with each other, as are the zone portions 37 on opposite sides of the score line 15. Thus, the tag 12 is securely fastened to the luggage handle, but no adhesive scrapes off on the luggage handle because of the varnish applied to desensitize the adhesive at the zone 35. The detached ticket 17 may be adhesively secured to an airline ticket jacket or the like.

The luggage tag 10 according to the invention may be readily fed through conventional handling equipment, such as OCR readers associated with a Datamax 5000 printer, or like printing equipment. The tag 10 has excellent tear resistance, and receipt portion 17 will not inadvertently separate.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A luggage tag attachable to the handle of a piece of luggage comprising:
   (a) an elongate strip of flexible material having a first end, a second end, a front, and a back;
   (b) a longitudinal fold line scored into the tag and extending from the first end of the tag to terminate at a root point between the first end and the second end, the tag being foldable about the fold line;
   (c) a detachable ticket integrally formed in the center of the tag and extending from the root of the fold line to the second end of the tag;
   (d) tongues formed in the tag on each side of the detachable ticket, the detachable ticket and tongues being configured and arranged so that removal of the ticket from the tag allows passage of the handle between the tongues;
   (e) attachment means for attaching one tongue to the other to enclose the handle thereby securing the tag to the handle;
   (f) a release liner to which said flexible material is attached, said release liner having dimensions slightly greater than the dimensions of said strip of flexible material; and
   (g) paper ties extending between said tongues and said detachable ticket, and between said root and said detachable ticket, for preventing undesired detachment of said detachable ticket from said elongate strip of flexible material while allowing clean and easy separation between the ticket and the tag; at least two ties being provided along each of said detachable ticket and adjacent tongue, and at least three paper ties being provided between said root and said detachable ticket.

2. A luggage tag as recited in claim 1, wherein each of said paper ties has a length of approximately 0.025 inches.

* * * * *